US011486276B2

(12) United States Patent
Boehme

(10) Patent No.: US 11,486,276 B2
(45) Date of Patent: Nov. 1, 2022

(54) VALVE ROTATING DEVICE

(71) Applicant: MAN Truck & Bus SE, Munich (DE)

(72) Inventor: Ulrich Boehme, Nuremberg (DE)

(73) Assignee: MAN TRUCK & BUS SE, Munich (DE)

( * ) Notice: Subject to any disclaimer, the term of this patent is extended or adjusted under 35 U.S.C. 154(b) by 0 days.

(21) Appl. No.: 17/298,302

(22) PCT Filed: Nov. 22, 2019

(86) PCT No.: PCT/EP2019/082237
§ 371 (c)(1),
(2) Date: May 28, 2021

(87) PCT Pub. No.: WO2020/109164
PCT Pub. Date: Jun. 4, 2020

(65) Prior Publication Data

US 2021/0388742 A1 Dec. 16, 2021

(30) Foreign Application Priority Data

Nov. 28, 2018 (DE) ..... 102018130098.0

(51) Int. Cl.
*F01L 1/32* (2006.01)
*F01L 1/46* (2006.01)
*F01L 3/08* (2006.01)

(52) U.S. Cl.
CPC ..... *F01L 1/32* (2013.01); *F01L 1/462* (2013.01); *F01L 3/08* (2013.01)

(58) Field of Classification Search
CPC ..... F01L 1/32; F01L 1/462; F01L 3/08
(Continued)

(56) References Cited

U.S. PATENT DOCUMENTS 2,613,656 A * 10/1952 Leach ..... F01L 1/32 123/90.29
2,758,583 A * 8/1956 Norton ..... F01L 1/32 123/90.3

(Continued)

FOREIGN PATENT DOCUMENTS

DE 2125346 A1 12/1971
EP 1167699 A1 1/2002

(Continued)

OTHER PUBLICATIONS

German Search Report issued in German Application No. 102018130098.0 dated Jun. 28, 2019. English translation not available.

(Continued)

*Primary Examiner* — Jorge L Leon, Jr.
(74) *Attorney, Agent, or Firm* — Weber Rosselli & Cannon LLP

(57) ABSTRACT

The invention relates to a valve rotating device (24) for a valve (10), preferably an intake valve or exhaust valve, of an internal combustion engine. The valve rotating device (24) has a valve restoring spring (22) for preloading the valve (10) toward a closed position of the valve (10) and a Belleville spring (40), which is arranged in operative connection between the valve restoring spring (22) and a support surface (44), which is lubricated with a lubricating fluid. An at least partially, preferably completely, peripherally extending collar portion (46) is arranged on a periphery, preferably inner periphery, of the Belleville spring (40). The collar portion (46) can have a wear-reducing effect and/or can make the valve rotating device (24) easier to install.

16 Claims, 4 Drawing Sheets

(58) Field of Classification Search
USPC ..... 123/90.28, 90.3, 90.67
See application file for complete search history.

(56) References Cited

U.S. PATENT DOCUMENTS

| | | | | | |
|---|---|---|---|---|---|
| 2,766,746 | A | * | 10/1956 | Geer | F01L 1/32 123/90.28 |
| 2,775,959 | A | * | 1/1957 | Geer | F01L 1/32 123/90.3 |
| 2,819,706 | A | * | 1/1958 | Gammon | F01L 1/32 123/90.3 |
| 2,827,885 | A | * | 3/1958 | Graham | F01L 1/32 123/90.29 |
| 2,827,886 | A | * | 3/1958 | Geer | F01L 1/32 123/90.3 |
| 2,835,236 | A | * | 5/1958 | Dadd | F01L 1/32 123/90.3 |
| 3,564,579 | A | * | 2/1971 | Meacham et al. | F01L 1/32 123/90.3 |
| 4,175,505 | A | * | 11/1979 | Shimada | F01L 1/32 123/90.3 |

FOREIGN PATENT DOCUMENTS

| | | | | | |
|---|---|---|---|---|---|
| FR | 1048649 | A | | 12/1953 | |
| GB | 1291502 | A | * | 10/1972 | F01L 1/32 |

OTHER PUBLICATIONS

PCT Search Report and Written Opinion issued in PCT/EP2019/082237 dated Feb. 3, 2020 with English translation.

* cited by examiner

VALVE ROTATING DEVICE

CROSS-REFERENCE TO RELATED APPLICATIONS

This application is a 371 application of PCT/EP2019/082237 which claims benefit of and priority to German Patent Application Serial No. DE 102018130098.0 filed Nov. 28, 2018, the disclosures of the above-identified applications are hereby incorporated by reference in their entirety.

The invention relates to a valve rotating device for a valve, preferably an intake valve or exhaust valve, of an internal combustion engine.

U.S. Pat. No. 2,827,885 A discloses a valve rotating device having a washer and a Belleville spring. Since the washer and the Belleville spring are situated under a valve coil spring on the cylinder head, its surfaces are normally supplied with oil from the valve stem and rocker lubrication system. This means that at any time the cylinder head is amply supplied with lubricating oil from the engine lubrication system and there is therefore always sufficient oil available for lubricating the surfaces. This oil is expelled from the space between the surfaces as the Belleville spring compresses. A sufficient delay nevertheless occurs in this escape of oil from between these surfaces, so that during part of the valve lift a film of oil is enclosed between these surfaces, increasing the frictionless seating contact while they are situated in an adjusted or parallel relationship to one another.

U.S. Pat. No. 2,613,656 A likewise discloses a valve rotating device having a Belleville spring. The Belleville spring normally has a conical configuration and the pressure which the valve coil spring exerts on it when the valve is closed is not sufficient to press the Belleville spring against the seating surface of the cylinder head. In the closed position the outer bottom edge of the Belleville spring gives rise to a substantially linear contact with the surface at a pressure sufficient to limit the rotation of the Belleville spring about the valve axis. As the load imposed on the Belleville spring by the valve coil spring increases when the valve is driven into the opening position, the Belleville spring folds, that is to say it bends parallel to the surface into a flattened configuration. The oil on the surface during this action is temporarily trapped between the surface, the step and the Belleville spring, and until it escapes under the Belleville spring serves to support the Belleville spring with a virtually negligible rotational resistance. This delay in the escape of oil and the resultant floating of the Belleville spring are of limited duration.

The object of the invention is to create an alternative and/or improved valve rotating device.

The object is achieved by the features of the independent claim 1. Advantageous developments are specified in the dependent claims and the description.

The invention creates a valve rotating device for a valve (for example a poppet valve), preferably an intake valve or exhaust valve, of an internal combustion engine. The valve rotating device comprises a valve return spring (for example in the form of a coil spring) for preloading the valve in a direction towards a closed position of the valve. The valve rotating device comprises a Belleville spring, which is arranged in operative connection between the valve return spring and a (for example stationary) support surface (of the valve rotating device or a cylinder head, for example) lubricated by a lubricating fluid. The Belleville spring is formed so that (only) on opening of the valve, for example, is it compressed into a flattened shape, preferably parallel to the support surface, under the force of the valve return spring, and in the flattened form is supported with sliding friction by the lubricating fluid between the Belleville spring and the support surface, to allow a rotation of the valve (for example by means of displacement contact). An at least partially, preferably fully circumferential, collar portion is arranged on a circumference, preferably the inner circumference, of the Belleville spring.

The collar portion is suitably capable of reducing any wear of the valve rotating device. In the rotation of the valve rotating device, the collar portion may serve, for example, to prevent the Belleville spring, rotating in operation, from cutting into a further valve element of the valve, for example a valve guide, on the inner circumference. Instead, the collar portion is capable of ensuring a flat-spread, wear-reducing seating contact. It is also possible for the collar portion to be formed so that it captively holds together multiple separate elements of the valve rotating device, for example also the Belleville spring and the valve return spring. This serves, for example, to facilitate fitting of the valve rotating device. In addition, the collar portion may suitably center the Belleville spring and/or the valve rotating device.

The expression "Belleville spring", as used herein, may preferably relate to an elastically deformable, annular, flattenable element.

In one exemplary embodiment the Belleville spring comprises an elastically deformable main body portion, preferably having a conical and annular disk shape. The collar portion may preferably be angled in relation to the main body portion, for example at an angle of 90°±50%, preferably 90°±25%. Alternatively or in addition, the collar portion may extend from the elastic main body. The collar portion may thereby be particularly effective, for example, in reducing wear.

In a further exemplary embodiment the collar portion confined the Belleville spring at its inner circumference.

In one design variant the collar portion is designed to extend substantially parallel to and/or coaxially with a valve axis of the valve and/or longitudinal axis of a valve body of the valve.

In a further exemplary embodiment the collar portion is arranged for the radial support of the Belleville spring, preferably radially in relation to a valve axis of the valve. This is an especially effective way, for example, of reducing wear by means of the collar portion.

In one embodiment the collar portion is arranged for flat-spread seating contact against a valve element of the valve, preferably a valve guide of the valve. This enables the collar portion to prevent or at least reduce wearing of the Belleville spring against the valve element.

In a further embodiment the Belleville spring comprises the collar portion. The collar portion can thereby easily be formed as a portion of the Belleville spring, which is a formed sheet-metal part, for example.

In a further embodiment a cylinder head comprises the support surface. This affords a particularly simple construction of the valve rotating device.

In a further embodiment the valve rotating device comprises an annular element, preferably a further Belleville spring or an annular washer. The annular element may preferably comprise the support surface. The support surface can therefore easily be provided by the annular element. The annular element can thus easily provide a further, hard and wear-resistant contact surface or mating surface.

The annular element may be elastically deformable, for example.

The annular element may be suitably supported in a cylinder head, preferably on a bottom surface of a recess of the cylinder head.

In one design variant the annular element is arranged in an operative connection between the Belleville spring and a cylinder head.

In a further design variant the annular element or the Belleville spring comprises the collar portion. The collar portion may therefore be a portion of the annular element or the Belleville spring, depending on the requirements.

In one exemplary embodiment the annular element comprises the collar portion. The collar portion may preferably grip partially around the Belleville spring, preferably on the inner circumference. The annular element is thereby capable of holding the Belleville spring captive by means of the collar portion. This can facilitate fitting.

In a further exemplary embodiment, the Belleville spring comprises the collar portion. The collar portion may preferably grip partially around the annular element, preferably on the inner circumference. The Belleville spring is thereby capable of holding the annular element captive by means of the collar portion. This can facilitate fitting.

In one embodiment the Belleville spring and the annular element are held captively together by the collar portion. They can thus preferably form one common assembly unit. This can facilitate fitting.

In one development the assembly unit is formed so that it can be fitted both with an orientation in which the Belleville spring is arranged on a side of the assembly unit facing the valve return spring, and also with an opposed orientation in which the annular element is arranged on the side of the assembly unit facing the valve return spring. The assembly unit can therefore be fitted on both sides. This is a simple means of preventing incorrect assembly.

In a further embodiment the Belleville spring is arranged in a recess of a cylinder head that can be or is filled with lubricating fluid. A further recess of the cylinder head for the collar portion may preferably be arranged in the recess.

The collar portion may suitably be of flange or sleeve-shaped formation.

The collar portion may feasibly have a height of between 1 mm and 20 mm, for example.

For example, the valve rotating device and/or the Belleville spring may be arranged coaxially with a displaceable valve body of the valve and/or coaxially with a valve guide of the valve.

In the closed state of the valve there may preferably be only an annular line contact between the Belleville spring and the support surface, preferably on an inner circumferential area of the Belleville spring.

For example, the Belleville spring may be in contact with the valve return spring and/or the support surface.

It is also possible for the annular element to be in contact with the Belleville spring and/or a cylinder head, preferably a bottom surface of a recess of the cylinder head.

The disclosure also relates to a cylinder head of an internal combustion engine, wherein the cylinder head comprises a valve (for example an intake or exhaust valve), a recess and a valve rotating device, as disclosed herein, which is arranged partially in the recess.

The invention also relates to a motor vehicle, preferably a commercial vehicle (for example a truck or a bus), having a valve rotating device as disclosed herein.

It is also possible to use the valve rotating device as disclosed herein for automobiles, large engines, off-road vehicles, fixed engines, marine engines etc.

The preferred embodiments and features of the invention hitherto described can be freely combined with one another. Further details and advantages of the invention are described below referring to the drawings attached, of which:

The embodiments shown in the figures correspond at least partially to one another, so that similar or identical parts are provided with the same reference numerals and are explained also through reference to the description of the other embodiments and figures, in order to avoid repetition.

Figure 1:
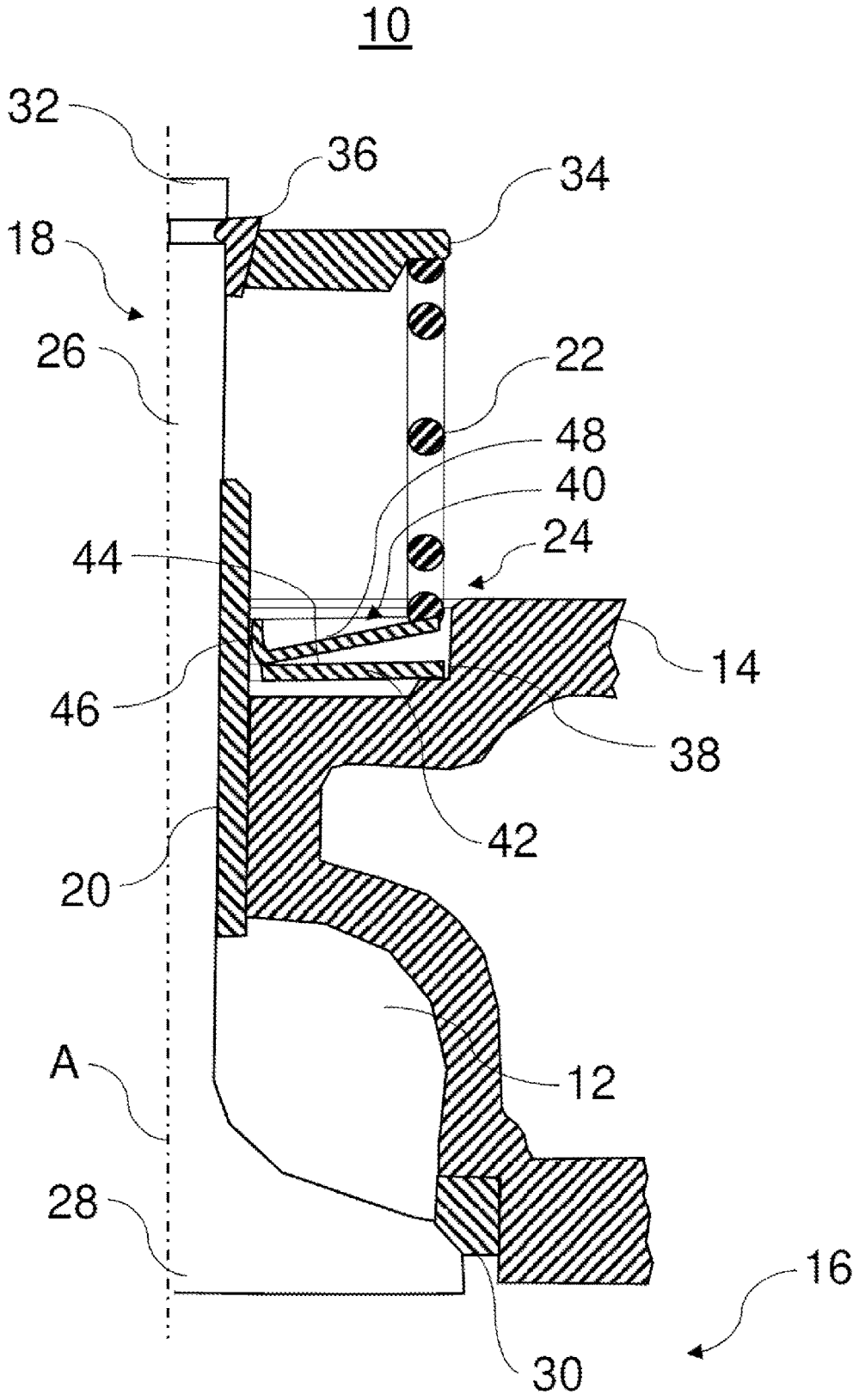
FIG. 1 shows a half-sectional view of a closed valve having an exemplifying valve rotating device according to the present disclosure.

FIG. 1 shows a valve 10 in half-section. The valve 10 may suitably be a valve of an internal combustion engine, for example a reciprocating-piston internal combustion engine. The internal combustion engine may be a diesel, petrol and/or gas-fueled internal combustion engine, for example. The valve 10 may preferably serve to connect a fluid passage 12 in a cylinder head 14 of the internal combustion engine and a combustion chamber 16 of the internal combustion engine to one another in the opened state or to separate them from one another in the closed state. For example, the valve 10 may be an intake valve and the fluid passage 12 an air or air/fuel mixture intake port. It is also possible, for example, for the valve 10 to be an exhaust valve and for the fluid passage 12 to be an exhaust port. The internal combustion engine may suitably be contained in a motor vehicle, preferably a commercial vehicle. The valve 10 may take the form, for example, of a poppet valve, as represented.

The valve 10 comprises a valve body 18, a valve guide 20, a valve return spring 22 and a valve rotating device 24. The valve return spring 22 can be regarded functionally as part of the valve rotating device 24.

The valve body 18 comprises a valve stem 26 and a combustion chamber-side closing part 28, for example of plate or disk shape. The valve stem 26 and the closing part 28 are connected to one another, preferably integrally in one piece. The valve body 18 is capable of reciprocating movement in the valve guide 20, for example of sleeve-shaped formation, for opening and closing the valve 10. The valve guide 20 may be arranged coaxially with the valve body 18 in the cylinder head 14.

As is shown in FIG. 1, when the valve 10 is in the closed state the closing part 28 lies forming a seal against a valve seat 30 in the cylinder head 14. The valve 10 forms a seal between the fluid passage 12 and the combustion chamber 16. With the valve 10 in the opened state (see FIG. 2) there is an annular gap between the closing part 28 and the valve seat 30, so that the fluid passage 12 and the combustion chamber 16 have a fluid connection to one another.

For opening and closing the valve 10, the valve 10 may be actuated, for example, by a suitably mechanical valve gear (not shown). For opening the valve 10 the valve gear may press on a free end 32 of the valve stem 26, in order to lift the closing part 28 from the valve seat 30. For example, the valve gear may comprise a force-transmitting element, for example a rocker arm, cam follower or tappet, for actuating the valve 10 and a camshaft for actuating the force-transmitting element. It is also possible to use other types of valve gears and actuating devices for actuating the valve 10, for example electromagnetic or electromotive devices.

The valve return spring 22 is operatively connected between the valve body 18 and the cylinder head 14. The valve return spring 22 preloads the valve 10 in the direction of the closed state. The valve return spring 22 thereby causes the valve 10 to close when it is no longer held open by the valve gear. The valve return spring 22 may take the form, in particular, of a coil spring. The valve return spring 22 may be arranged coaxially with the valve body 18 and the valve guide 20. The valve return spring 22 may be supported on a valve head 34 of the valve 10. The valve head 34 can be fixed to the valve stem 26 at its free end 32, for example by means of a clamping piece 36. The clamping piece 36, for example, may engage in one or more circumferential grooves on the free end 32 of the valve stem 26. It is also possible for the valve return spring 22 and/or the valve head 34 to be connected to the valve stem 26 in some other way.

The valve return spring 22 is supported on the cylinder head 14 by means of the valve rotating device 24. The valve rotating device 24 is designed so that it allows the valve return spring 22 or the valve 10 to rotate when the valve 10 opens and closes. The rotary momentum for the rotation can be imparted by the helical shape of the valve return spring 22.

The valve rotating device 24 is arranged at least partially in a recess 38 in the cylinder head 14. During operation, lubricating fluid, for example oil, collects in the recess 38. For example, the lubricating fluid drips into the recess 38 from a valve gear arranged above it.

In the embodiment shown the valve rotating device 24 comprises a Belleville spring 40 and an annular element 42. It is also possible for the annular element 42 to take the form, for example, of a further Belleville spring or an annular washer. The Belleville spring 40 and/or the annular element 42 may each be formed, for example, as a sheet-metal part, preferably a formed sheet-metal part.

The Belleville spring 40 is arranged between the valve return spring 22 and the annular element 42. An upper side of the Belleville spring 40 is in contact with the valve return spring 22 on an outer circumferential area of the Belleville spring 40. An underside of the Belleville spring 40 is in contact with the annular element 42 on an inner circumferential area of the Belleville spring 40. With the valve 10 in the closed state a line contact suitably results between the Belleville spring 40 and the annular element 42.

The annular element 42 is arranged between the Belleville spring 40 and a bottom surface of the recess 38. An upper side of the annular element 42 is in contact with the Belleville spring 40 on an inner circumferential area of the annular element 42. An underside of the annular element 42 is in contact with the bottom surface of the recess 38, preferably on an outer circumferential area of the annular element 42.

The upper side of the annular element 42 forms a support surface 44 for the Belleville spring 40. Due to the arrangement of the annular element 42 in the recess 38, the support surface 44 is lubricated by the lubricating fluid in the recess 38. The Belleville spring 40 is formed so that on opening of the valve 10 (see FIG. 2) it is elastically deformed due to the increasing spring force of the valve return spring 22 and flattens until it is substantially parallel to the support surface 44. It is also possible for the annular element 42 to be likewise elastically deformed in the process.

The lubricating fluid is expelled from a diminishing gap between the support surface 44 and the underside of the Belleville spring 40. The actuation of the valve 10 occurs so rapidly, however, that a lubricating fluid film remains between the support surface 44 and the underside of the Belleville spring 40. The lubricating fluid film makes it possible for the Belleville spring 40 to allow a virtually frictionless rotation of the valve return spring 22 through sliding friction due to a so-called displacement contact on the support surface 44. The lubricating fluid film between the underside of the Belleville spring 40 and the support surface 44 absorbs the valve spring force. The Belleville spring 40 and the annular element 42 are separated from one another by the lubricating fluid film. The friction, particularly in a circumferential direction, approximates to zero. The rotational momentum due to the compression of the valve return spring 22 is capable of rotating the valve 10. This rotation does not vary as a function of specific rotational speeds and does not depend on the dynamics of the valve gear.

Figure 2:
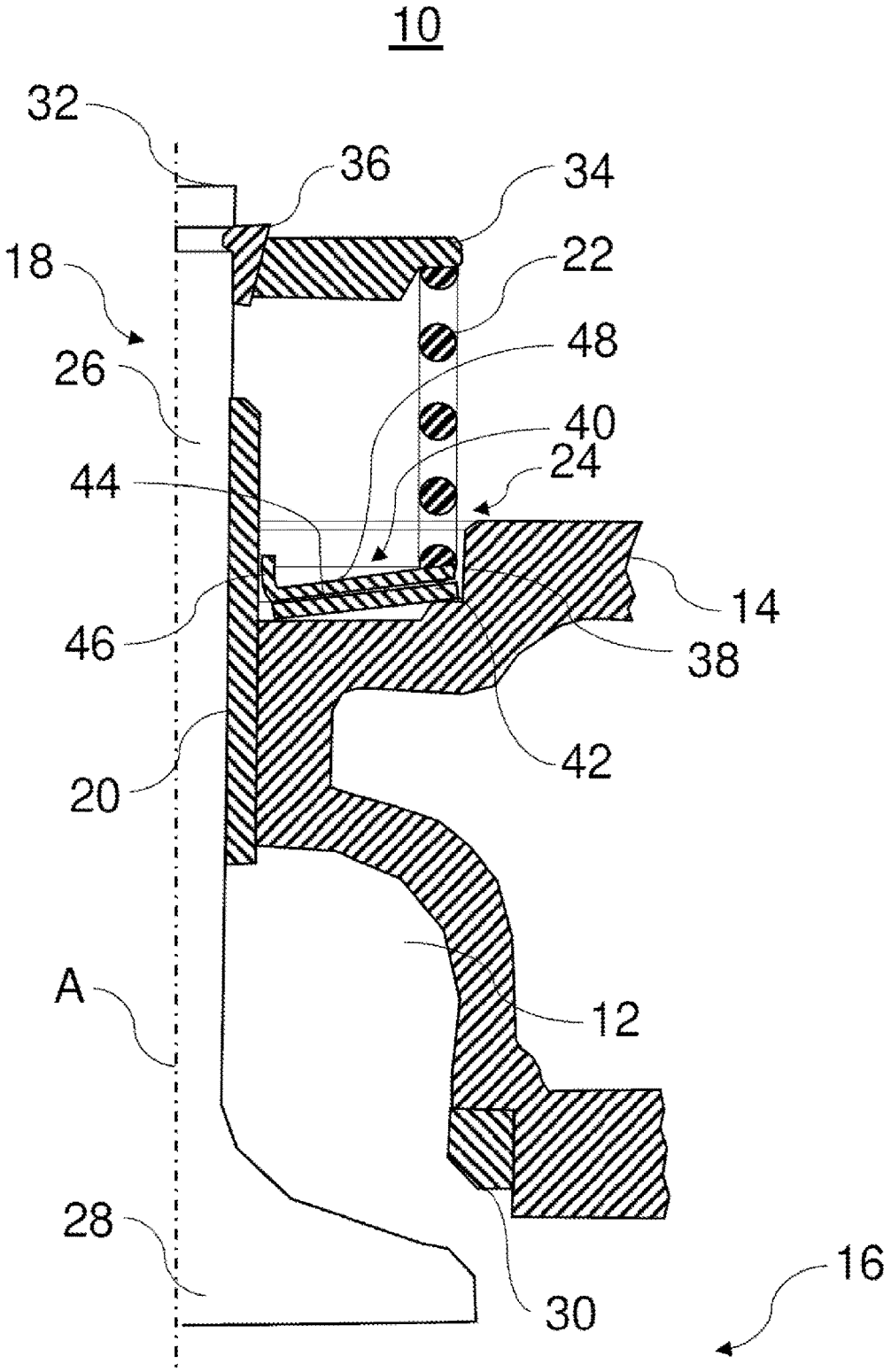
FIG. 2 shows a half-sectional view of an opened valve having the exemplifying valve rotating device according to the present disclosure.

In the embodiment shown in FIGS. 1 and 2 the Belleville spring 40 comprises an elastically deformable main body portion 48 and a circumferential collar portion 46. The main body portion 48 has a conical and annular disk shape. The collar portion 46 is arranged on the main body portion 48 on the inner circumferential side. The collar portion 46 extends from the main body portion 48 at an angle to the main body portion 48.

The collar portion 46 is capable of allowing a flat-spread seating contact of the Belleville spring 40 against an outer surface of the valve guide 20. It can therefore serve to prevent the Belleville spring 40 cutting successively, for example abradingly, into the valve guide 20 during its rotation, and in so doing causing wear both to the valve guide 20 and to the Belleville spring 40. The collar portion 46 therefore serves to support the Belleville spring 40 in a radial direction relative to a longitudinal axis A of the valve 10. The collar portion 46 may have a height, for example, in the single or two-digit millimeter range.

It is also possible, for example, for the annular element rather than the Belleville spring to comprise the collar portion, for the purpose of preventing the Belleville spring and/or the annular element cutting into the valve guide.

Figure 3:
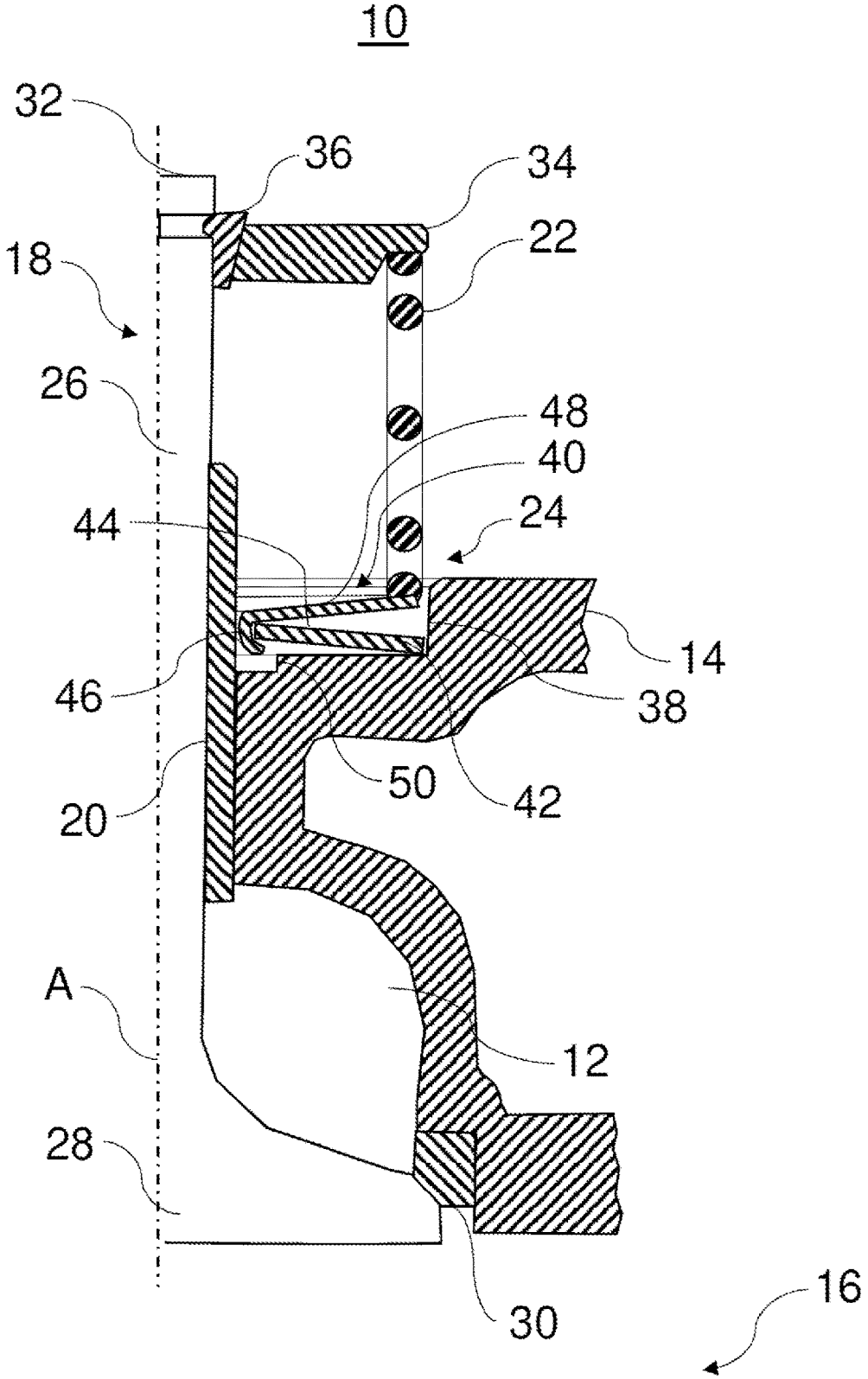
FIG. 3 shows a half-sectional view of a closed valve having a further exemplifying valve rotating device according to the present disclosure.

FIG. 3 shows a further exemplary embodiment of the valve rotating device 24. Here the collar portion 46 of the Belleville spring 40 is arranged so that it grips around the annular element 42 on the inner circumferential side. In particular, the collar portion 46 of the Belleville spring 40 together with the main body portion 48 forms an annular recess, in which the annular element 42 is partially received. The annular element 42 can thereby be purposely held captive by the Belleville spring 40 when assembling the valve rotating device 24. The annular element 42 and the Belleville spring 40 may thus form a common assembly unit that is easy to fit.

It is possible in this exemplary embodiment, too, for the annular element rather than the Belleville spring to comprise the collar portion. The collar portion may grip partially around the Belleville spring, so that the Belleville spring and the annular element are held captively together.

The assembly unit formed by the Belleville spring 40 and the annular element 42 may have the further advantage that it can be fitted on both sides. This means that the assembly unit comprising the Belleville spring 40 and the annular element 42 can be fitted both with an orientation in which the Belleville spring 40 is in contact with the valve return spring 22, and with an orientation in which the annular element 42 is in contact with the valve return spring 22. This suitably serves to further improve the ease of fitting, since incorrect assembly is precluded.

It is possible for a further recess 50 for the collar portion 46 to be formed in the recess 38, as represented in FIG. 3. The further recess 50 is capable of partially receiving the collar portion 46 when the valve 10 is opened.

Figure 4:
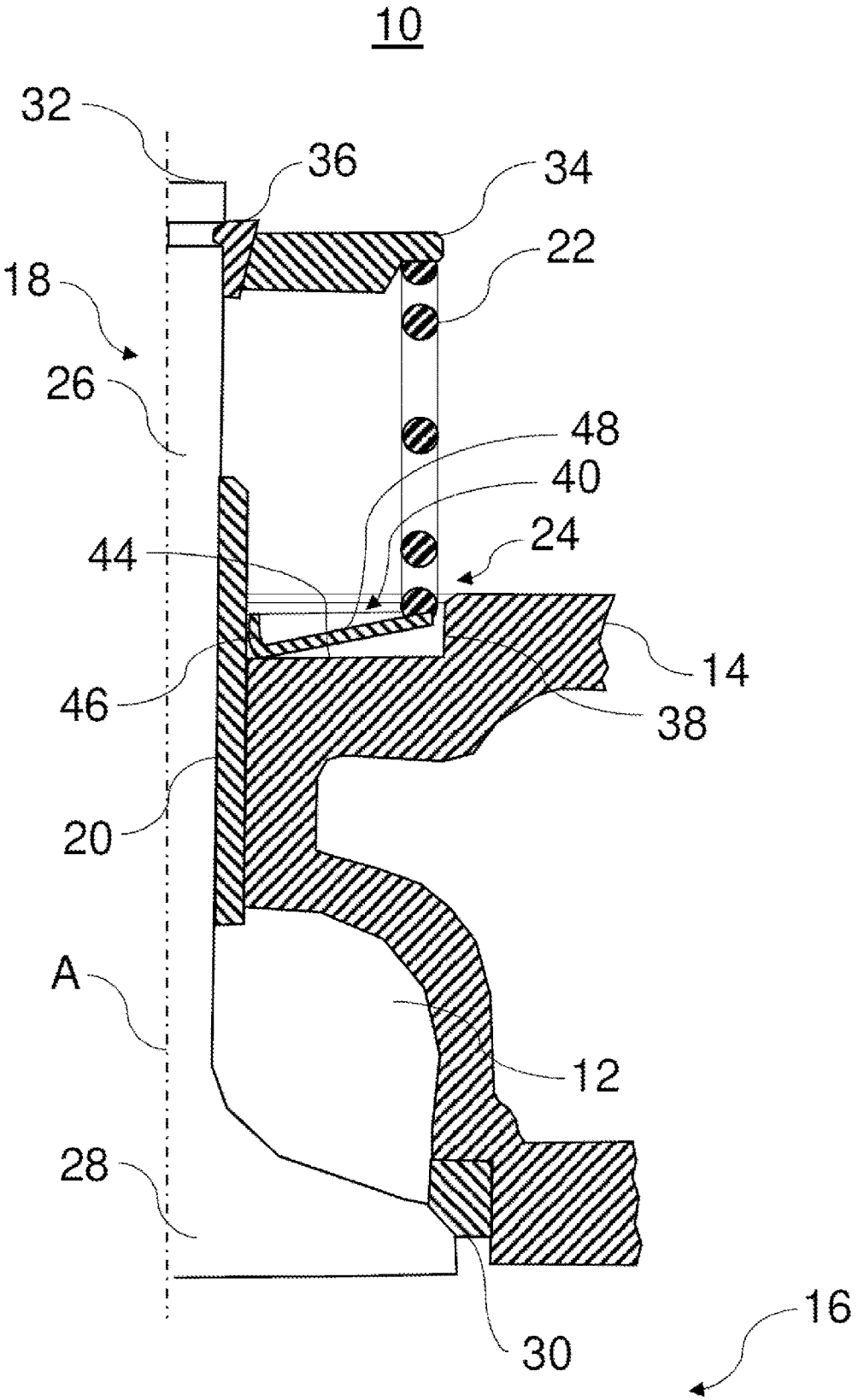
FIG. 4 shows a half-sectional view of a closed valve having a yet another exemplifying valve rotating device according to the present disclosure.

FIG. 4 shows a further exemplary embodiment of the valve rotating device 24. Here the valve rotating device 24 comprises only the Belleville spring 40. The support surface 44 for the Belleville spring 40 is formed by a bottom surface of the recess 38.

The invention is not limited to the preferred exemplary embodiments described above, a number of variants and modifications instead being possible, which likewise make use of the idea of the invention and therefore come into the scope of the patent. In particular, the invention also claims protection for the subject matter and the features of the dependent claims independently of the claims referred to. In particular, the features of the independent claim 1 are disclosed independently of one another. In addition, the features of the dependent claims are also disclosed independently of all features of the independent claim 1 and, for example, independently of the features relating to the presence and/or the configuration of the valve return spring, the Belleville spring and/or the collar portion of the independent claim 1. All ranges specified herein are disclosed on the understanding that virtually all values falling within the respective range are disclosed individually, for example also as respective preferred narrower outer limits of the respective range.

LIST OF REFERENCE NUMERALS

A valve axis
10 valve
12 fluid passage
14 cylinder head
16 combustion chamber
18 valve body
20 valve guide
22 valve return spring
24 valve rotating device
26 valve stem
28 closing part
30 valve seat
32 free end
34 valve head
36 clamping piece
38 recess
40 Belleville spring
42 annular element
44 support surface
46 collar portion
48 main body portion
50 further recess

The invention claimed is:

1. A valve rotating device for a gas exchange valve of an internal combustion engine, the valve rotating device comprising:

a valve return spring configured to bias the valve in a direction towards a closed position of the valve;

a Belleville spring arranged in operative connection between the valve return spring and a lubricated support surface the Belleville spring configured to be compressed into a flattened shape under a force of the valve return spring when the valve is opened so as to be supported with sliding friction by a lubricating fluid between the Belleville spring and the support surface which enables a rotation of the valve; and a fully circumferential collar portion extending from an inner circumference of the Belleville spring.

2. The valve rotating device as claimed in claim 1, wherein:

when in the flattened shape, the Belleville spring is parallel to the support surface.

3. The valve rotating device as claimed in claim 1, wherein:

the Belleville spring comprises an elastically deformable main body portion having a conical and annular disk shape, and:

the collar portion is angled in relation to the main body portion.

4. The valve rotating device as claimed in claim 1, wherein:

the collar portion extends substantially parallel to and/or coaxially with a valve axis of the valve and/or a longitudinal axis of a valve body of the valve.

5. The valve rotating device as claimed in claim 1, wherein:

the collar portion is configured to radially support of the Belleville spring.

6. The valve rotating device as claimed in claim 5, wherein:

the collar portion is configured to radially support the Belleville spring with respect to a valve axis of the valve.

7. The valve rotating device as claimed in claim 1, wherein:

the collar portion lays flat against a valve element of the valve.

8. The valve rotating device as claimed in claim 7, wherein:

the valve element is a valve guide of the valve.

9. The valve rotating device as claimed in claim 1, wherein:

a cylinder head comprises the support surface.

10. The valve rotating device as claimed in claim 1, further comprising:

an annular element which comprises the support surface.

11. The valve rotating device as claimed in claim 10, wherein:

the annular element is a second Belleville spring or a washer.

12. The valve rotating device as claimed in claim 10, wherein:

the annular element is arranged in an operative connection between the Belleville spring and a cylinder head.

13. The valve rotating device as claimed in claim 10, wherein:

the collar portion grips partially around an inner circumferential side of the annular element.

14. The valve rotating device as claimed in claim 10, wherein:

the Belleville spring and the annular element are coupled together via the collar portion so as to form a common assembly unit.

15. The valve rotating device as claimed in claim 1, wherein:

the Belleville spring is arranged in a first recess of a cylinder head, the first recess configured to be filled with lubricating fluid, and the collar portion is arranged in a second recess of the cylinder head, the second recess arranged in the first recess.

16. A motor vehicle comprising the valve rotating device as claimed in claim 1.

* * * * *